United States Patent [19]

Tsuchiya et al.

[11] 4,311,893

[45] Jan. 19, 1982

[54] PUSH BUTTON ASSEMBLY

[75] Inventors: Hidetaka Tsuchiya; Kouichi Nakajima, both of Tanashi, Japan

[73] Assignee: Citizen Watch Co., Ltd., Tokyo, Japan

[21] Appl. No.: 140,676

[22] Filed: Apr. 15, 1980

[30] Foreign Application Priority Data

Jun. 22, 1979 [JP] Japan ..... 54-85608[U]

[51] Int. Cl.[3] ..... H01H 9/00; H01H 13/14

[52] U.S. Cl. ..... 200/340; 200/5 A; 200/159 B

[58] Field of Search ..... 200/340, 159 B, 5 A, 200/5 B, 5 E

[56] References Cited

U.S. PATENT DOCUMENTS 4,066,860 1/1978 Kawasaki ..... 200/159 B

*Primary Examiner*—Willis Little

*Attorney, Agent, or Firm*—Birch, Stewart, Kolasch & Birch

[57] ABSTRACT

A push button assembly for a wristwatch, tabletop calculator and the like is disclosed, made of plastic by molding. The push button assembly comprises a plurality of push buttons which are connected with each other by resilient connecting branches with each other. A pair of resilient connecting branches for each push button are symmetrically positioned about the central point of the top of the push button, so that each push button may be axially moved without tilting.

4 Claims, 4 Drawing Figures

PUSH BUTTON ASSEMBLY

BACKGROUND OF THE INVENTION

The present invention relates to a push button assembly for small electronic instruments such as a watch, tabletop calculator, and the like.

In such an instrument, it is desirable to reduce the area occupied by the push button. In a typical prior art configuration, each push button of the assembly is held by a resilient metal blade with a frame. Such a push button assembly occupies a relatively wide area owing to the frame. Further, the push button tends to tilt when depressed, which increases the sliding friction of the push button to thereby deteriorate the operability of the push button.

SUMMARY OF THE INVENTION

The object of the present invention is to provide a push button assembly which may be reduced in size and each button of which may be moved in the axial direction without tilting.

In accordance with the present invention, there is provided a push button assembly made of plastic comprising a plurality of push buttons, a pair of resilient connecting branches formed on opposite portions of each push button, said resilient connecting branches being symmetrical about the central point of the top of said bush button, adjacent connecting branches being connected with each other, and a supporting means provided at each junction of said adjacent connecting branches for supporting the connecting branches.

Other objects and advantages will become apparent from the following description with reference to the accompanying drawings.

Figure 1:
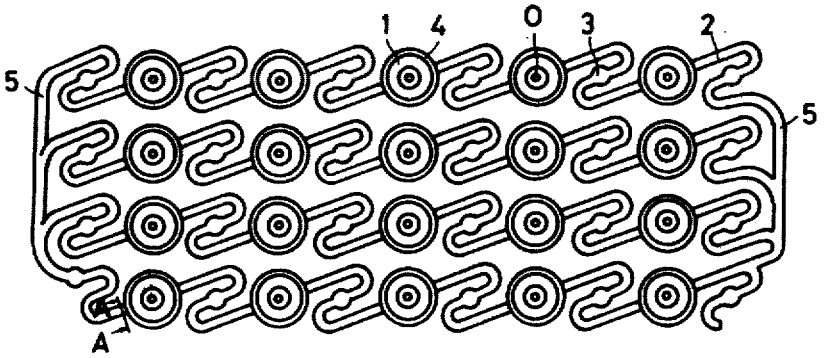
FIG. 1 is a plan view showing a push button assembly of the present invention.
Figure 2:
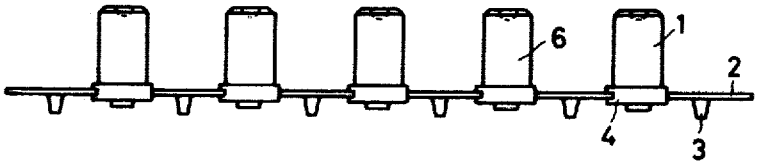
FIG. 2 is a side elevational view of the push button assembly.
Figure 3:
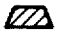
FIG. 3 is a sectional view along the line A—A in FIG. 1.

DESCRIPTION OF THE PREFERRED EMBODIMENTS:

Referring to the drawings and more particularly to FIGS. 1 and 2, a push button assembly of the present invention comprises a plurality of push buttons 1. Each push button comprises a push button body 6, a flange 4 formed on a lower portion of the push button body and a pair of resilient connecting branches 2 formed on the opposite portions of the flange 4. Each connecting branch has a J-shape and opposite connecting branches are symmetrical about the central point "O" of the push button. Adjacent branches are connected with each other at a supporting means 3, so that a S-shaped branch may be formed in symmetry about the supporting means 3. Thus, a row of push buttons may be formed. A plurality of push button rows are connected by connecting members 5 at the ends, so that a push button assembly may be formed. Such a push button assembly is integrally formed by molding a plastic. The connecting branch has a elasticity and has a tapered cross section as shown in FIG. 3 in order to facilitate the molding operation. The supporting means 3 comprises a projection extending from the connecting branch.

Figure 4:
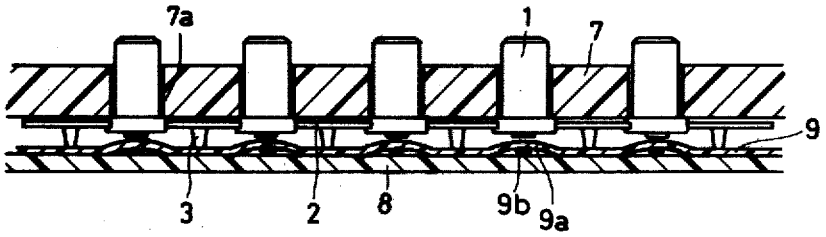
FIG. 4 is a sectional view showing a use of the push button assembly.

FIG. 4 shows an example of the use of the present invention. The push button assembly 1 is disposed between a case 7 of a watch or tabletop calculator and a base plate 8. Each push button 1 is inserted into the corresponding hole 7*a* of the case 7, projecting therefrom. The flange 4 serves to prevent the push button from being removed. A flexible sheet 9 having a plurality of protrusions 9*a* corresponding to the push buttons is disposed on the base plate 8. The projected supporting means 3 of the push button assembly is abutted on the flexible sheet. A contact 9*b* is provided on the underside of each projection 9*a*.

When the push button 1 is depressed, opposite connecting branches 2 are symmetrically deflected about respective projected supporting means 3. Thus, the push button may be axially moved without tilting. The corresponding projection 9*a* of the flexible sheet 9 is depressed by the push button so that the contact 9*b* makes a contact on the base plate 8. The push button is returned by the operation of the connecting branches 2. It will be understood that the supporting means 3 may be provided on the flexible sheet 9 instead of providing on the connecting branches 2.

In accordance with the present invention, the push button assembly may be made in a small area, because a frame for supporting the resilient connecting branch is not provided. The push button may be smoothly moved without tilting because of symmetrically disposed connecting branches.

What is claimed is:

1. A push button assembly made of plastic comprising a plurality of push buttons; a pair of resilient connecting branches formed on opposite portions of each push button, said resilient connecting branches being symmetrical about the central point of the top of said push button, each of said resilient connecting branches being in a plain perpendicular to the axial line of said push button, adjacent connecting branches being connected with each other; and a supporting means extending parallel to the axial line of said push button provided at each junction of said adjacent connecting branches for supporting the connecting branches.

2. A push button assembly according to claim 1 wherein said supporting means is projected perpendicular from the underside of the junction of adjacent connecting branches.

3. A push button assembly according to claim 1 wherein each resilient connecting branch has a J-shape and is connected to an adjacent branch in a symmetrical disposition.

4. A push button assembly made of plastic comprising a plurality of rows of push buttons; a pair of resilient connecting branches formed on opposite portions of each push button, said resilient connecting branches being symmetrical about the central point of the top of the said push button, each of said resilient connecting branches being in a plane perpendicular to the axial line of said push button, adjacent connecting branches being connected with each other to form said plurality of rows of push buttons; connecting members connecting the ends of said rows of push buttons; and supporting means extending parallel to the axial line of said push button provided at each junction of said adjacent connecting branches and adjacent connecting members for supporting said branches and members.

* * * * *